US007693458B2

(12) United States Patent
Kikuchi

(10) Patent No.: US 7,693,458 B2
(45) Date of Patent: Apr. 6, 2010

(54) CHARGING DEVICE, PROCESS CARTRIDGE, AND IMAGE FORMING APPARATUS

(75) Inventor: Nobuo Kikuchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 172 days.

(21) Appl. No.: 11/760,140

(22) Filed: Jun. 8, 2007

(65) Prior Publication Data

US 2007/0292161 A1 Dec. 20, 2007

(30) Foreign Application Priority Data

Jun. 20, 2006 (JP) ..... 2006-169489

(51) Int. Cl.
*G03G 15/02* (2006.01)

(52) U.S. Cl. ..... 399/176; 399/123; 399/357; 430/105

(58) Field of Classification Search ..... 399/110, 399/111, 113, 123, 176, 349, 357; 430/105
See application file for complete search history.

(56) References Cited

U.S. PATENT DOCUMENTS

| | | | | |
|---|---|---|---|---|
| 2,297,691 | A | 10/1942 | Carlson | |
| 5,512,708 | A | 4/1996 | Takahashi et al. | |
| 5,557,373 | A | 9/1996 | Miyashita et al. | |
| 5,572,293 | A | 11/1996 | Kikuchi et al. | |
| 5,585,896 | A | 12/1996 | Yamazaki et al. | |
| 6,205,310 | B1 * | 3/2001 | Onishi | 399/176 |
| 6,819,893 | B2 | 11/2004 | Kikuchi | |
| 2007/0196123 | A1 * | 8/2007 | Mizuishi et al. | 399/176 |

FOREIGN PATENT DOCUMENTS

| | | |
|---|---|---|
| JP | 43-24748 | 10/1943 |
| JP | 49-23910 | 6/1974 |
| JP | 2-301777 | 12/1990 |
| JP | 3-52058 | 8/1991 |
| JP | 6-82227 | 10/1994 |
| JP | 7-60273 | 6/1995 |
| JP | 7-140762 | 6/1995 |
| JP | 3174987 | 4/2001 |
| JP | 3244892 | 10/2001 |

OTHER PUBLICATIONS

U.S. Appl. No. 12/109,037, filed Apr. 24, 2008, Kikuchi.

* cited by examiner

*Primary Examiner*—Stephen F Husar
(74) *Attorney, Agent, or Firm*—Oblon, Spivak, McClelland, Maier & Neustadt, L.L.P.

(57) ABSTRACT

Toner having spindle-shaped particles is used to form images in an image forming apparatus. Each spindle-shaped particle has a ratio of a length in a minor axis to a length in a major axis in a range from 0.5 to 0.8 and a ratio of a thickness to the length in the minor axis in a range from 0.7 to 1.0. A charging device applies an electric charge onto an electrostatic latent-image carrier of the image forming apparatus. The charging device includes a charging roller, a surface roughness of which is equal to or smaller than 10 micrometers.

6 Claims, 3 Drawing Sheets

CHARGING DEVICE, PROCESS CARTRIDGE, AND IMAGE FORMING APPARATUS

CROSS-REFERENCE TO RELATED APPLICATIONS

The present document incorporates by reference the entire contents of Japanese priority document, 2006-169489 filed in Japan on Jun. 20, 2006.

BACKGROUND OF THE INVENTION

1. Field of the Invention

The present invention relates to a charging device configured to be used in an image forming apparatus based on an electrophotographic technology, a process cartridge including the charging device, and an image forming apparatus including the charging device.

2. Description of the Related Art

Various types of conventional electrophotographic methods are disclosed in, for example, U.S. Pat. No. 2,297,691, Japanese Examined Patent Publication No. S49-23910, and Japanese Examined Patent Publication No. S43-24748. In the electrophotographic method, a copy is obtained by forming an electric latent image on a photoconductor by using a photoconductive material in various ways, developing the latent image with a dry toner, transferring the toner image onto a paper or the like, and fixing the toner image by applying heat and pressure.

Methods for developing the electric latent image can be roughly divided into liquid developing methods and dry developing methods. In the liquid developing methods, a developer is used, which is obtained by having various types of pigments or dyes finely dispersed in an electrically-insulating organic liquid. In the dry developing methods such as a cascade method, a magnetic brush method, and a powder cloud method, a toner is used, which is obtained by having a colorant such as carbon black dispersed in a natural resin or a synthetic resin. The dry developing methods can further be divided into one-component developing methods and two-component developing methods that require a carrier.

With increasing demand for high quality images, particles of the toner have become smaller and sphere, recently. Especially, copy images or printed images with a high definition and a high resolution have been strongly demanded. To obtain such images having the high definition and the high resolution, Japanese Patent Application Laid-Open Nos. H1-112253, H2-284158, and H7-295283 disclose a developer having a specific content and a specific distribution of toner particles each having an average diameter equal to or smaller than 5 micrometers. The toner particles having the diameter equal to or smaller than 5 micrometers are a requisite component for forming the images with the high definition and the high resolution. By smoothly supplying the toner when a latent image is developed, it is possible to obtain the image accurately reproducing the latent image without spreading out of the edges, that is, the image with a high reproductivity. However, because toner particles have become smaller and sphere, there tends to increase an amount of residual toner that still remains on the photoconductor after a cleaning device cleans the toner from the photoconductor after the image is transferred.

Japanese Patent Application Laid-open No. S63-149668 discloses a charging roller method in which a charging device is in contact with a photosensitive member during charging.

Japanese Patent Application Laid-open Nos. H7-140762, H7-140868, and H2-301777 disclose methods for cleaning the charging roller.

However, in the arrangements described above, even if the amount of the residual toner that still remains on the photoconductor after the cleaning device cleans the photoconductor is extremely small, the toner gradually accumulates on the surface of the charging roller, which causes lowering in a charging efficiency over the course of time. This is not a problem to be considered in low-speed printers or copying machines that are in popular lines of products, because the charging device or the process cartridges that include a charging device are replaced at about tens of thousands printing operations. However, in medium-speed or high-speed printers or copying machines, because the replacement cycle is hundreds of thousands of printing operations, the charging efficiency is lowered due to the imperfect cleaning, and the output images have abnormalities such as background smudges over the course of time. A solution for the above problems has been in high demand.

SUMMARY OF THE INVENTION

It is an object of the present invention to at least partially solve the problems in the conventional technology.

According to an aspect of the present invention, a charging device configured to apply an electric charge onto an electrostatic latent-image carrier in an image forming apparatus that forms an image with toner having spindle-shaped particles, each spindle-shaped particle having a ratio of a length in a minor axis (r2) to a length in a major axis (r1) (r2/r1) in a range from 0.5 to 0.8 and a ratio of a thickness (r3) to the length in the minor axis (r2) (r3/r2) in a range from 0.7 to 1.0, the charging device includes a charging roller that applies the electric charge onto an electrostatic latent-image carrier, wherein a surface roughness of the charging roller is equal to or smaller than 10 micrometers.

According to another aspect of the present invention, a process cartridge includes the above charging device.

According to still another aspect of the present invention, an image forming apparatus includes the above charging device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

An example of a toner particle used in the present invention is explained.

Figure 1A:
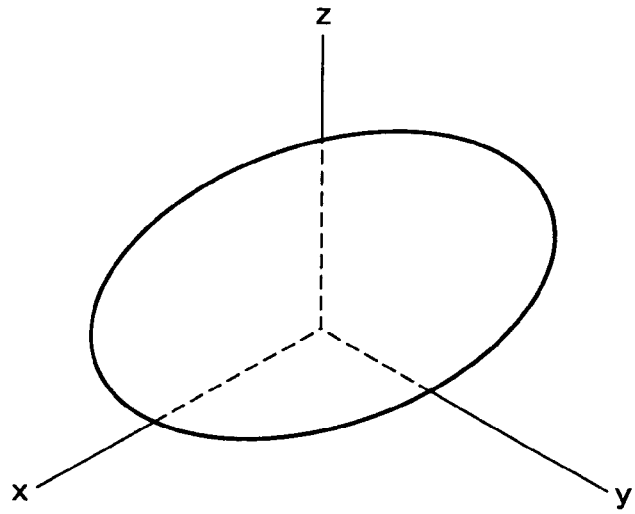
FIG. 1A is a perspective view of a toner particle used in an embodiment of the present invention.
Figure 1B:
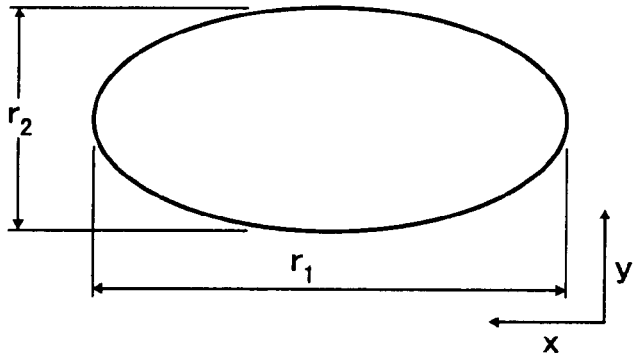
FIGS. 1B and 1C are cross-sectional views of the toner particle shown in FIG. 1A.
Figure 1C:
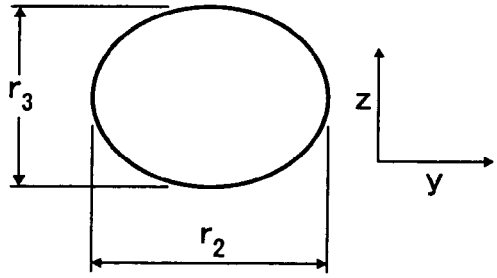

FIG. 1A is a perspective view of a toner particle used in an embodiment of the present invention. FIGS. 1B and 1C are cross-sectional views of the toner particle. The toner particle is spindle shaped. If the shape of toner particles are indefinite (which means the shape of the toner particles are not uniform) or flattened, the toner particles have a lower fluidity. As a result, an output image is likely to have a problem such as background smudges, because it is not possible to smoothly perform a friction charging process. Also, when it is required to develop a latent image with significantly small dots, the dot reproductivity tends to be lower, because it is difficult to arrange the toner particles accurately and uniformly. Furthermore, when an electrostatic transfer method is used, a transfer efficiency tends to be lower because the toner particles are not easily affected by a line of electric force. If the toner particle is substantially sphere, the toner particles are likely to be scattered outside of the dots in a developing process or in a transfer process, because the toner particles excessively react against an external force due to the high fluidity. Furthermore, because the sphere toner particles, which easily roll on a photoreceptor, are likely to get into a gap between the photoreceptor and a cleaning member, an amount of a residual toner that is still remains after cleaning increases. The residual toner can adhere to a charging unit (charging roller) located downstream, and the charging roller is defiled with the residual toner.

Because the spindle-shaped toner particle according to the embodiment has a properly adjusted fluidity, it is possible to perform a friction charging process smoothly, place no smudges on the background, accurately develop the latent images even with the significantly small dots, and efficiently transfer the toner image. It means that the spindle-shaped toner particles also have a high dot reproductivity. Moreover, the properly adjusted fluidity causes the spindle-shaped toner particles not to be scattered easily. Still moreover, because the number of rotation axes of the spindle-shaped toner particle is much smaller than those of the sphere toner particle, the spindle-shaped toner particle is not likely to get into under the cleaning member. Therefore, the amount of the residual toner that is still remains after cleaning decrease, and the charging unit (charging roller) located downstream is not likely to be defiled with the residual toner.

More particularly, the toner particle is spindle-shaped having a ratio of a length in the minor axis (r2) to a length in the major axis (r1) (i.e., r2/r1) in a range from 0.5 to 0.8, and a ratio of the thickness (r3) to the length in the minor axis (i.e., r3/r2) in a range from 0.7 to 1.0.

If the ratio of the length in the minor axis to the length in the major axis (r2/r1) is smaller than 0.5, that is, the shape is apart from a perfect sphere, the cleaning efficiency becomes higher, but it is not possible to obtain an image with high quality due to the lower dot reproductivity and the lower transfer efficiency. If the ratio of the length in the minor axis to the length in the major axis and (r2/r1) is larger than 0.8, that is, the shape is substantially sphere, there is a possibility that the imperfect cleaning occurs especially in an environment at a low temperature and with a low humidity.

If the ratio of the thickness to the length in the minor axis (r3/r2) is smaller than 0.7, that is, the toner particle is flat, the toner particles are less likely to be scattered like the indefinite-shaped toner particles are scattered. However, it is not possible to obtain the transfer efficiency as high as the sphere-shaped toner particles have. Especially, if the ratio of the thickness to the length in the minor axis (r3/r2) is 1.0, the toner particle becomes a rotational body having the major axis as a rotation axis. If the spindle-shaped toner particle has the ratio r3/r2 closer to 1, that is, the toner particle is not any one of indefinite, flat, and sphere, the toner particles can enjoy the advantages of both the sphere shape and the flat shape, that is, can obtain the appropriate properties in the friction charging, the dot productivity, the transfer efficiency, the scattering resistance, and the cleaning efficiency.

It is possible to measure r1, r2, and r3 by, for example, uniformly scattering and adhering the toner particles to a smooth surface for measurement, and magnifying a hundred of the toner particles at 500 times with a color laser microscope "VK-8500" (manufactured by KEYENCE CORPORATION), measuring the length in the major axis r1 (micrometers), the length in the minor axis r2 (micrometers), and the thickness r3 (micrometers) of each of the hundred toner particles, and calculating an arithmetic average from the results of measurement.

Figure 2:
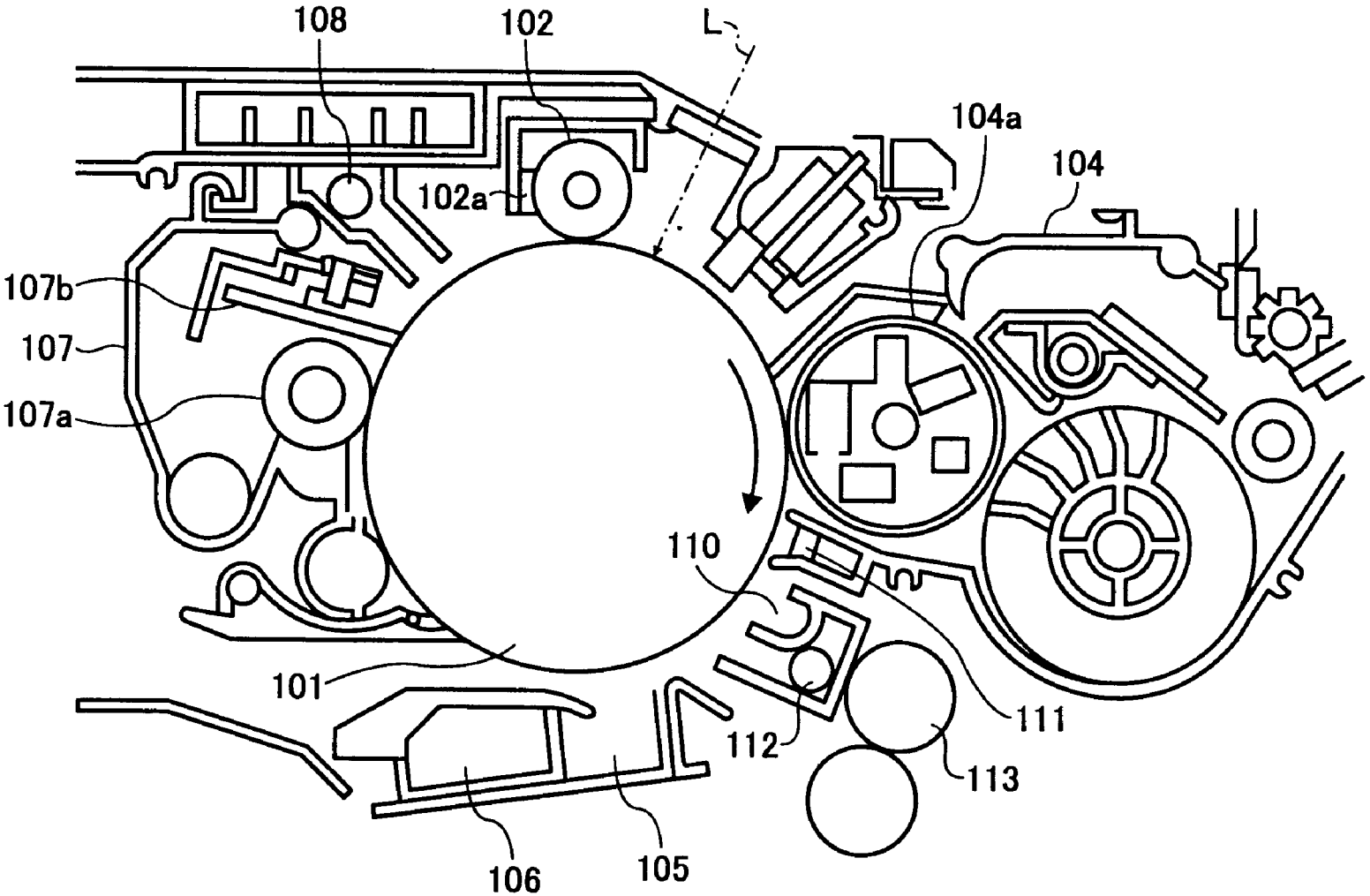
FIG. 2 is a side view of an image forming apparatus according to an embodiment of the present invention.

FIG. 2 is a side view of an image forming apparatus according to an embodiment of the present invention. The reference numeral 101 denotes a photoconductor that forms an electrostatic latent image by performing an electrophotographic process. Provided around the photoconductor 101 are a charging roller 102, a charging-roller cleaner 102*a*, a developing unit 104, a transfer charger 105, and a separating charger 106. The charging roller 102 is a contact-type charging roller made of hydrin rubber, rotates associated with the photoconductor 101, and is charged with either a direct current voltage or a direct current voltage overlapped with an alternate current voltage. The charging-roller cleaner 102*a* is made of a non-woven fabric, and is in contact with a surface of the charging roller 102 to clean the surface. The developing unit 104 exposes the surface of the photoconductor 101 to a light from an optical system (not shown) in an exposure process L, and adheres the toner to the electrostatic latent image on the photoconductor 101 formed as a result of the exposure process L (i.e., develops an image) by using a magnetic brush roller 104*a*. The transfer charger 105 transfers the toner image formed on the photoconductor 101 onto a surface of recording paper. The separating charger 106 electrically separates the recording paper that is closely adhered to the photoconductor 101 from the photoconductor 101. The charging-roller cleaner 102*a* can be made of a sponge material, a fur, or a rubber, and can be shaped in a brush or a blade. The cleaning member in the charging-roller cleaner 102*a* can be in the form of a roller that is rotatable. The charging roller 102 can be made of a resin material such as polycarbonate (PC) or acrylonitrile butadiene styrene (ABS). When the charging roller 102 is a non-contact type charging roller, it is necessary to provide a step on an end of the charging roller 102 to form a gap with a predetermined length. Examples of the methods for providing the gap include making the radius of each of the ends of the charging roller larger by the predetermined length by fitting roller rings around the ends, or by putting a tape around the ends.

As shown in FIG. 2, provided on the circumferential surface of the photoconductor 101 are a cleaning unit 107, a quenching lamp (QL) 108, a pre-transfer charger 110, a potential sensor 111, and a pre-transfer lamp (PTL) 112. The cleaning unit 107 collects the residual toner on the photoconductor 101 after the transfer process with a fur brush 107*a* and a cleaning blade 107*b*. The fur brush 107*a* and the cleaning blade 107*b* are in contact with the photoconductor 101 in a trailing manner as shown in FIG. 2. It is acceptable to attach the fur brush 107*a* and the cleaning blade 107*b* in a counter manner. After the cleaning process, the QL 108 initializes a residual potential on the surface of the photoconductor 101 to zero by using a light from a fluorescent tube. Before the transfer process, the pre-transfer charger 110 homogenizes the charging amount of the toner image formed on the photoconductor 101 to improve the transfer efficiency. The potential sensor 111 that is positioned opposed to the main scanning direction on the surface of the photoconductor 101, reads the potential on the surface of the photoconductor 101, and sends the read potential to a control unit (not shown). Before the transfer process, the PTL 112 lowers the potential on the surface of the photoconductor 101 using the light from the fluorescent tube to improve the transfer efficiency. The reference numeral 113 denotes a resist roller that is positioned parallel to the photoconductor 101 and conveys the recording paper at a predetermined timing so that the recording paper is aligned with a forward end of the toner image formed on the photoconductor 101.

A basic operation is explained along a copying process performed by a copying machine. First, when a print start key in an operating unit (not shown) provided on the top of the copying machine is pushed, a series of copying process starts. An original document to be copied is illuminated by the optical system (not shown). While the original document is illuminated, a reflected light that is reflected by a lens or a mirror (not shown) projected onto the surface of the photoconductor 101 (the exposure process L). When the reflected light corresponding to the image on the original document have been projected onto the surface of the photoconductor 101, the electric charges in the exposed parts are removed depending on the intensity of the reflected light, so that an electrostatic latent image is formed on the photoconductor 101. Subsequently, the magnetic brush roller 104*a* of the developing unit 104 develops the electrostatic latent image (i.e., adheres the toner to the electrostatic latent image) to form a toner image on the photoconductor 101.

Recording paper conveyed by a paper conveying unit (not shown) is further conveyed to the transfer unit by the resist roller 113 at the proper timing so that the paper is aligned with the forward end of the toner image formed on the photoconductor 101.

The transfer charger 105 transfers the toner image formed on the photoconductor 101 onto the recording paper that is conveyed by the resist roller 113. After the transfer process, the recording paper is separated from the photoconductor 101 by the separating charger 106. After that, the recording paper is conveyed to a fixing unit (not shown) where the fixing process is performed on the recording paper, and is ejected from the copying machine. Thus, the series of processes are completed.

After the transfer process, the cleaning unit 107 removes the residual toner from the photoconductor 101. The QL 108 removes the residual electric charge from the photoconductor 101 to initialize the photoconductor 101. After that, the copying machine is in a standby state until receiving a next image processing instruction.

Figure 3:
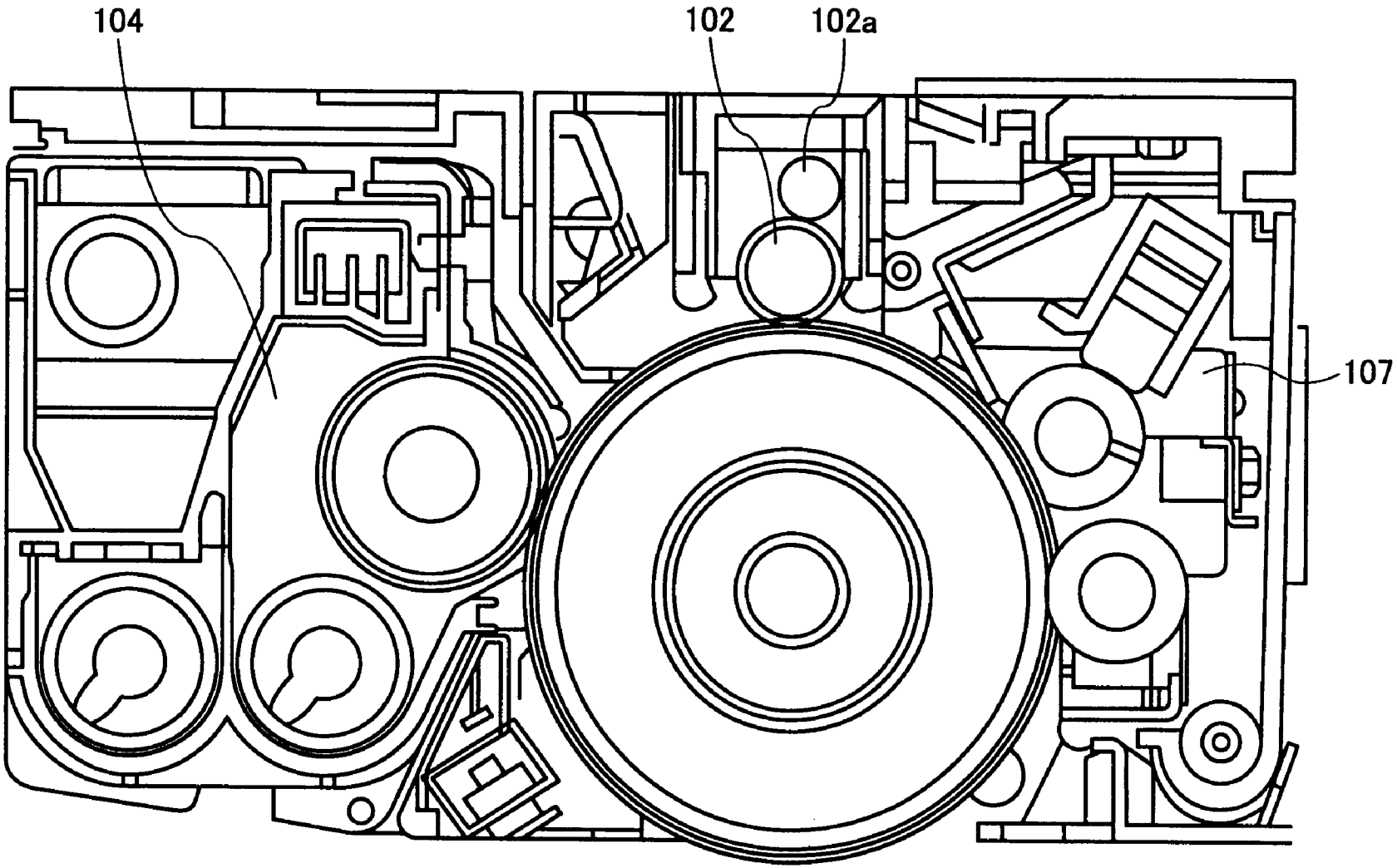
FIG. 3 is a side view of a process cartridge according to an embodiment of the present invention.

FIG. 3 is a side view of a process cartridge according to an embodiment of the present invention. The process cartridge for forming an image is applicable to an arrangement in which a part or all of the units related to the image forming process is integrally assembled, more particularly, the photoconductor 101 is integrally assembled with any one or more of the units described above such as the charging roller 102, the charging-roller cleaner 102*a*, the developing unit 104, and the cleaning unit 107.

The process cartridge is also applicable when the charging roller 102 is the non-contact type and has members (e.g. a roller ring, a tape) on the ends of the charging roller 102 to form the gap of 5 micrometers to 60 micrometers.

Shown in Tables 1 and 2 are results of a printing test of 300,000 sheets on the toner and the image forming apparatus according to the embodiments.

In the printing test, the toner adhered to the charging roller and the charging efficiency are evaluated on two types of the charging rollers having the surface roughness of 10 micrometers and 15 micrometers. The printing test is conducted on each of the two charging rollers, changing each of the hardness and the surface resistance to three different levels.

TABLE 1

| Surface roughness of the charging roller: 15 micrometers | | | | |
|---|---|---|---|---|
| | | Surface resistance (MΩ) | | |
| | | 15 | 80 | 170 |
| Hardness | 80 | Bad | Bad | Bad |
| | 50 | Bad | Bad | Bad |
| | 25 | Bad | Bad | Bad |

In Table 1, under each of all the conditions, the toner is adhered to the surface of the charging roller, and the background was smudged due to lowering of the charging efficiency.

TABLE 2

| Surface roughness of the charging roller: 10 micrometers | | | | |
|---|---|---|---|---|
| | | Surface resistance (MΩ) | | |
| | | 15 | 80 | 170 |
| Hardness | 80 | Not good | Good | Not good |
| | 50 | Good | Good | Good |
| | 25 | Not good | Good | Not good |

In Table 2, "Not good" indicates that the toner is slightly adhered to the charging roller, but no smudge due to lowering of the charging efficiency was found in the background, and "Good" indicates that no toner is adhered to the charging roller, and the charging efficiency does not decrease.

As described above, when the extremely small sphere-shaped toner particles are used, there increase an amount of the residual toner that is still remained on the photoconductor 101 after the cleaning device cleans the toner from the photoconductor after the transfer process, and the residual toner accumulates on the surface of the charging roller, which causes lowering of the charging efficiency over the course of time. In contrary, when the spindle-shaped toner particles are used, more particularly, each having the ratio of the length in the minor axis r2 to the length in the major axis r1 (r2/r1) in a range from 0.5 to 0.8 and the ratio of the thickness r3 to the length in the minor axis r2 (r3/r2) in a range from 0.7 to 1.0, there is a lower possibility that the problem caused by the imperfect cleaning occurs. Moreover, the charging roller 102 that electrically charges the photoconductor 101 serving as an electrostatic latent-image carrier is charged with the bias voltage and has the surface roughness Rz equal to or smaller than 10 micrometers. Thus, even if some of the toner is not caught by the cleaning blade 107*b* and is adhered to the charging roller 102, because the number of the rotation axes of the toner particle is small, it is possible to easily clean up the toner by using the charging-roller cleaner 102*a*. Consequently, the lowering of the charging efficiency caused by adhesion of toner is prevented, and it is therefore possible to obtain an image with a high quality. The residual toner due to the imperfect cleaning is adhered to the charging roller electrostatically or mechanically. When the charging roller 102 is a contact type, the toner is adhered both electrostatically and mechanically. When the charging roller 102 is a non-contact type, the toner is adhered electrostatically.

As for the hardness of the charging roller, the harder the charging roller is, the higher the pressure applied to the toner is. Thus, when the hardness is higher, the toner is more likely to adhere to the charging roller, and it is disadvantageous in terms of keeping the charging roller clean. On the contrary, when the hardness of the charging roller is low, it is difficult to apply a sufficient contact charge to the photoconductor. Thus, there is a higher possibility that defective charging occurs, that the pressure on a part in contact with the cleaner becomes uneven, and that the cleaning efficiency becomes lower.

However, when the hardness of the charging roller 102 and the toner are adjusted in the ranges defined according to the embodiments, it is possible to prevent the residual toner from adhering to the charging roller and to prevent the cleaning efficiency from lowering. Thus, it is possible to easily clean up the toner and to prevent adherence of the toner.

As for the surface resistance of the charging roller, the lower the surface resistance of the charging roller is, the more advantageous it is in terms of keeping the charging roller clean. This is because when the toner that is not caught by the cleaning blade comes in contact with the charging roller, a charge injection (i.e., a counter charge) is less likely to occur. Therefore, an electrostatic adhesion is less likely to occur. However, if the surface resistance is too low, the force of an electric absorption between the charging roller and the toner that has once adhered to the charging roller is stronger, and it tends to be more difficult to clean up the toner with the cleaner.

To cope with the problem, according to the embodiments, the surface resistance of the charging roller and the toner particle are adjusted in the ranges as described above. As a result, it is possible to prevent the adherence of toner to the charging roller and the lowering of the cleaning efficiency. Thus, it is possible to easily clean up the toner and to prevent the adherence of toner.

Because the charging roller is in the shape of a stick having a small diameter, a test piece in the shape of a flat plate is prepared to measure the surface resistance. A donut-shaped (tube-shaped) electrode placed on the test piece and a cylinder-shaped electrode placed in the middle of the donut-shaped electrode are used for the measurement (a distance between the electrodes is 1 centimeter). The resistance is calculated from an electric current flowing when a 100-volt direct current voltage is applied to the donut-shaped electrode and the cylinder-shaped electrode for 30 seconds.

According to an embodiment of the present invention, it is possible to provide a charging device, a process cartridge, and an image forming apparatus that can obtain a high quality image by preventing the lowering of the charging efficiency caused by the adhesion of toner and that can easily clean up the toner.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A charging device configured to apply an electric charge onto an electrostatic latent-image carrier in an image forming apparatus that forms an image with toner having spindle-shaped particles, each spindle-shaped particle having a ratio of a length in a minor axis (r2) to a length in a major axis (r1) (r2/r1) in a range from 0.5 to 0.8 and a ratio of a thickness (r3) to the length in the minor axis (r2) (r3/r2) in a range from 0.7 to 1.0, the charging device comprising:

a charging roller that applies the electric charge onto an electrostatic latent-image carrier, wherein a surface roughness of the charging roller is equal to or smaller than 10 micrometers; and a charging-roller cleaner that is made of a non-woven fabric and is in contact with a surface of the charging roller to clean the surface, wherein a hardness of the charging roller is in a range from 30 degrees to 70 degrees in terms of Japanese industrial standards (JIS) A, wherein a surface resistance of the charging roller is in a range from 20 megaohms to 160 megaohms.

2. The charging device according to claim 1, wherein the charging roller is contact type.

3. The charging device according to claim 1, wherein the charging roller is non-contact type.

4. A process cartridge comprising a charging device configured to apply an electric charge onto an electrostatic latent-image carrier in an image forming apparatus that forms an image with toner having spindle-shaped particles, each spindle-shaped particle having a ratio of a length in a minor axis (r2) to a length in a major axis (r1) (r2/r1) in a range from 0.5 to 0.8 and a ratio of a thickness (r3) to the length in the minor axis (r2) (r3/r2) in a range from 0.7 to 1.0, the charging device including:

a charging roller that applies the electric charge onto an electrostatic latent-image carrier, wherein a surface roughness of the charging roller is equal to or smaller than 10 micrometers; and a charging-roller cleaner that is made of a non-woven fabric and is in contact with a surface of the charging roller to clean the surface, wherein a hardness of the charging roller is in a range from 30 degrees to 70 degrees in terms of Japanese industrial standards (JIS) A, wherein a surface resistance of the charging roller is in a range from 20 megaohms to 160 megaohms.

5. An image forming apparatus comprising the process cartridge according to claim 4.

6. An image forming apparatus comprising a charging device configured to apply an electric charge onto an electrostatic latent-image carrier in an image forming apparatus that forms an image with toner having spindle-shaped particles, each spindle-shaped particle having a ratio of a length in a minor axis (r2) to a length in a major axis (r1) (r2/r1) in a range from 0.5 to 0.8 and a ratio of a thickness (r3) to the length in the minor axis (r2) (r3/r2) in a range from 0.7 to 1.0, the charging device including:

a charging roller that applies the electric charge onto an electrostatic latent-image carrier, wherein a surface roughness of the charging roller is equal to or smaller than 10 micrometers; and a charging-roller cleaner that is made of a non-woven fabric and is in contact with a surface of the charging roller to clean the surface, wherein a hardness of the charging roller is in a range from 30 degrees to 70 degrees in terms of Japanese industrial standards (JIS) A, wherein a surface resistance of the charging roller is in a range from 20 megaohms to 160 megaohms.

* * * * *